United States Patent [19]

Pelton

[11] Patent Number: 4,941,647

[45] Date of Patent: Jul. 17, 1990

[54] PROTECTIVE LINING FOR ALUMINUM REFINING VESSEL

[75] Inventor: John F. Pelton, Yorktown Heights, N.Y.

[73] Assignee: Union Carbide Corporation, Danbury, Conn.

[21] Appl. No.: 406,277

[22] Filed: Sep. 12, 1989

[51] Int. Cl.[5] ..... C22B 21/06

[52] U.S. Cl. ..... 266/285; 432/251

[58] Field of Search ..... 266/280, 235, 285, 242, 266/200; 75/68 R, 65 R; 432/251; 264/30

[56] References Cited

U.S. PATENT DOCUMENTS

| | | | |
|---|---|---|---|
| 3,043,055 | 7/1962 | Davey | 432/251 |
| 3,980,742 | 9/1976 | Szekely | 264/30 |
| 4,040,610 | 8/1977 | Szekely | 266/235 |
| 4,717,126 | 1/1988 | Pelton | 266/200 |

*Primary Examiner*—S. Kastler

*Attorney, Agent, or Firm*—A. H. Fritschler

[57] ABSTRACT

A refractory sheet member is positioned in a cut-out portion of graphite side and end plates of an aluminum holding and refining vessel to create an effective barrier to the flow of molten aluminum through the channel formed upon the pulling of the plates apart when the vessel is heated to operating temperature.

6 Claims, 1 Drawing Sheet

PROTECTIVE LINING FOR ALUMINUM REFINING VESSEL

BACKGROUND OF THE INVENTION

1. Field of the Invention

This apparatus relates to a vessel for the refining of molten aluminum. More particularly, it relates to a protective lining for such a vessel.

2. Description of the Prior Art

In aluminum refining vessels, the refining chamber is frequently an externally heated cast iron tub. If the tub walls were bare, the turbulent molten aluminum present therein during refining operations would dissolve the cast iron at a very rapid rate. This would result in a very short tub life, e.g., no more than a few days for a cast iron wall 1½ inches thick. Such dissolving of the cast iron would also result in an unacceptable iron contamination of the aluminum. To slow down this unacceptable wash-out process, the cast iron tub is completely lined with refractory plates and shapes. In the area of the cast iron tub wall that is externally heated, the lining is composed of graphite. Because graphite has a much higher thermal conductivity than any other material that is resistant to attack by molten aluminum, it is the only suitable material for such use. If the tube lining were made of the next best material from a thermal conductivity standpoint, e.g., silicon carbide, the extra temperature drop throught the lining, because of its lower thermal conductivity, would necessarily result in a higher, excessive tub wall temperature and a consequent rapid failure of the cast iron because of cracking, bulging and the like.

Such a refractory lining does not serve to keep molten aluminum from contacting the tub wall. It would be very difficult, and certainly impractical, to make a lining that was completely liquid tight. Not only would this be difficult to accomplish, but it would also be undesirable, again for thermal conductivity reasons. Molten aluminum that occupies the space between the lining and the tub wall provides an excellent thermal conduction path between the two parts. If this space were only gas filled, the tube wall would have to be much hotter in order to transfer the required amount of heat to the interior of the refining vessel. This, in turn, would lead to an early failure of the cast iron tub.

If the molten aluminum that penetrates the space between the refractory lining and the tub wall is static, it will dissolve iron from the cast iron tub until it becomes saturated, this being about 2 to 3% iron at normal operating temperatures. Under the worst circumstances (from the tub wall viewpoint), the molten aluminum will react with enough iron to form an iron aluminum containing 42% iron. This level of iron consumption represents only an insignificant loss of iron from the cast iron tub wall. Significant losses of iron occur, on the other hand, when molten aluminum is allowed to circulate into and out of this space. If there are openings in the lining, such circulation will occur, driven by thermal density gradients, composition density gradients (aluminum with dissolved iron being more dense than pure aluminum), and to a very great extent, during refining operations, by the fluid forces created by the spinning nozzle employed in such operations. Such circulating currents have been known to wash out, i.e. dissolve a hole through, a 1½ inch thick gray iron tub wall in a few weeks. This type of circulation generally occurs when the molten aluminum from the refining space within a vessel enters the space between the lining and the tub wall through a small hole or a slot between two parts of the refractory lining.

A part of the problem of tub wash-out is caused by the loss of graphite due to oxidation. When the refining system is at idle and is not well inerted on the inside of the vessel, the portion of the graphite lining plates above the molten aluminum level will be lost as a result of oxidation. This can be controlled by careful sealing of the refining space, but, in practice, this is not commonly done in many aluminum refining shops. Once, some part of a graphite plate has been oxidized away down to below the operating level of molten aluminum in the vessel, the side wall of the cast iron tub will no longer be protected at that point. While that particular part of the tub wall may be coated with enough dross to prevent actual contact between the cast iron of the tub and the molten aluminum, the molten aluminum nevertheless has a large entry point for passage into the space behind the lining. If there also is an exit point due to openings between lining plates and shapes, particularly one near the bottom of the refining vessel, then rapid circulation of molten aluminum behind the lining can occur, resulting in the undesired, rapid wash-out of the cast iron tub wall.

Oxidation of the graphite lining above the idle level can be effectively eliminated by covering this portion of the graphite plate with a non-oxidizable material that is not attached by molten aluminum. Silicon nitride bonded silicon carbide is a good material for this purpose. A skirt of this material can be placed so as to rest on top of the graphite plate and be clamped to the cast iron tub so that it will maintain its position on top of the graphite plate and not slide off into the vessel. This clamping also serves to hold the graphite plates down and prevents said plates from floating upward when the vessel assembly is filled with molten aluminum. The upper end of the graphite plate is thus held or effectively clamped against the cast iron tub wall. The silicon carbide skirt that rests on top of the graphite plate extends downward over the inner surface of said graphite plate past the upper operating molten aluminum level and to below the lower idle molten aluminum level, so as to afford protection for the graphite against oxidation in the refining space above the level of molten aluminum in the vessel.

In order to eliminate most of the channels for flow of molten aluminum into and out of the space between the graphite lining and the tub wall, the bottom, sides and at least one end of the vessel are desirably lined with single pieces of graphite with no through openings. The side plates and the end plate are joined to the bottom plate, typically by known tongue and groove joints. When the lining is installed in the cast iron tub in this manner, the various pieces are fitted close together and against the tub walls, and any gaps between the joined plates are filled with cement.

When the refining vessel is heated to operating temperature, the tub expands more than the lining because of its higher thermal expansion coefficient. Under this circumstance, the tub on longer holds the pieces of the lining in close contact with one another. Since the graphite side and end plates are clamped to the walls of the tub by the refractory skirts as indicated above, these graphite plates are actually pulled apart at the upper end thereof. The lower ends of the graphite plates, however, are held in contact with one another by their tongue and groove joints with the bottom plate. This movement creates openings between the side plates and end plate at their upper ends, thus providing a channel for the flow of molten aluminum between the refining space within the vessel and the space between the graphite lining and the cast iron tub. A tongue and groove joint cannot be used between the back graphite plate and the side graphite plates because such a joint would restrain the necessary outward motion of either the side or the end plate during heat-up. Such restraint would result in either fracture of the tongue and groove joint or in the dislodging of the refractory skirt or the breaking of the graphite plates. It is highly desirable, however, that a means be found to create a joint not subject to the opening of a channel for molten aluminum flow upon the necessary movement of the graphite plates upon heating the refining vessel to operating temperature.

It is an object of the invention, therefore, to provide an improved joint between the graphite side plates and the end plates of an aluminum refining vessel.

It is a further object of the invention to provide a joint between said graphite side plates and the end plate that will allow relative motion as required during heat-up, while still maintaining an effective barrier to the flow of molten aluminum through the joint.

With these and other objects in mind, the invention is hereinafter described in detail, the novel features thereof being pointed out in the appended claims.

SUMMARY OF THE INVENTION

The invention resides in the positioning of a refractory sheet member in a cut-out created in the joint between the side graphite plate and the end graphite plate, said sheet member being adapted to remain in said cut-out to preclude the passage of molten aluminum through the openings between said plates and the upper end thereof created upon movement of the plates as the refining vessel is heated to operating temperature.

BRIEF DESCRIPTION OF THE DRAWINGS

The invention is hereinafter described with reference to the accompanying drawings in which.

DETAILED DESCRIPTION OF THE INVENTION

Figure 1:
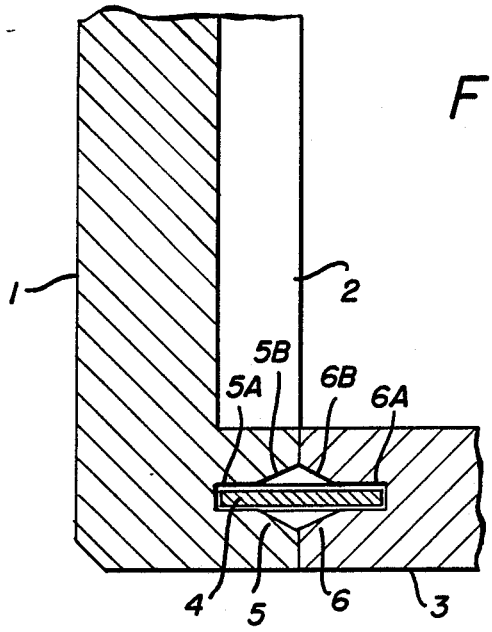
FIG. 1 is a top elevational view, in schematic form, of the joint between graphite side and back plates of a refining vessel, with the refractory sheet member of the invention inserted therein, upon construction and before being heated to operating temperature.

The refractory sheet member positioned in a cut-out in the joint between the graphite side plate and the graphite end plate would not be necessary if the plates were to remain fitted close together as in the FIG. 1 position upon heating the vessel to the desired operating temperature, for the holding of molten aluminum, with or without the refining thereof. However, the graphite plates do pull apart at their upper end upon heating of the refining vessel to operating temperature, with the lower ends of the plates being held together by tongue and groove joints. Therefore, the refractory sheet member of the invention provides a convenient and effective means for preventing the passage of molten aluminum through the opening thus created between said side and end plates.

Figure 2:
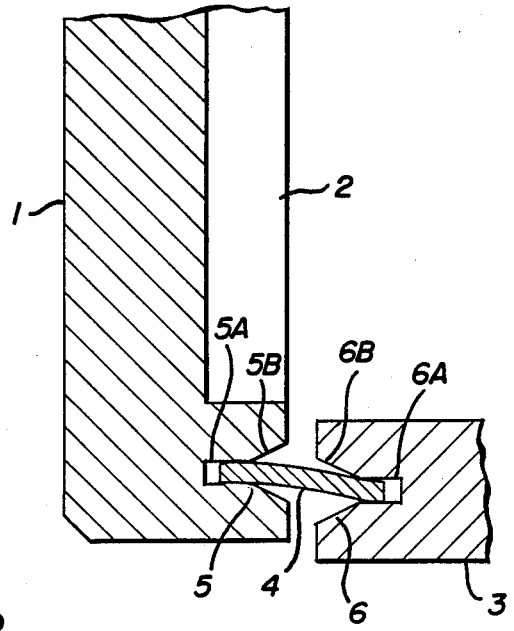
FIG. 2 is a top elevational view, in schematic form, of the joint of FIG. 1 following heat up to operating temperature.

Referring to FIG. 1, an end graphite plate is represented by the numeral 1, and has a cut-out portion 2 for the non-oxidizable skirt to rest upon as indicated in the background description above. Side graphite plate 3 is illustrated as being fitted closely to end plate 1 as upon assembly of the vessel. However, as shown in FIG. 2, end plate 1 and side plate 3 are pulled apart upon being heated to the desired refining operating temperature. Refractory sheet member 4 is shown in FIG. 1 as originally installed in the joint between the plates, with FIG. 2 illustrating its position under operating conditions, wherein it remains in position to effectively prevent the passage of molten aluminum through the opening created upon the pulling apart of plates 1 and 3.

For purposes of installing said sheet member 4, companion cut-out portions 5 and 6 of plates 1 and 3 are provided at corresponding positions, e.g. in the middle, of the thickness of the plates at the joint between said plates. Cut-out portions 5 and 6 are shown in generally preferred "Y" shaped configuration, having an inner, narrower portion, i.e. portions 5A and 6A, respectively, and enlarged portions, i.e. portions 5B and 6B, facing each other. This arrangement enables refractory sheet member 4 to be conveniently positioned and retained in the cut-outs.

In the illustrated embodiment, refractory sheet member 4 is sufficiently wide so that the opposite ends thereof remain positioned within narrow portions 5A and 6A after end plate 1 and side plate 3 have been pulled apart as shown in FIG. 2. Thus, refractory sheet member 4 is able to effectively prevent the flow of molten aluminum through the opening between the plates during operations at refinery operating temperature. For this purpose, refractory sheet member 4 should be of sufficient width and thickness to fit snuggly within narrow cut-out portions 5A and 6A when end plate 1 and side plate 3 are in abutting contact, as in the FIG. 1 position, and to remain in an essentially snug fitting position, maintaining an effective barrier to the flow of molten aluminum, although it necessarily assumes an angled position due to the off-set of said plates 1 and 3 as in the FIG. 2 position.

It will be appreciated that the cut-out portions 5 and 6 are similarly sized, relative to the length and width of sheet member 4, so that the positioning of said sheet member 4 in the cut-out portions enables said effective barrier to the passage of molten aluminum to be created and maintained under operating temperature conditions. Thus, inner, narrower portions 5A and 6A of the illustrated FIG. 1 embodiment are sufficiently wide so that the opposite ends of sheet member 4, upon being angled, as in the FIG. 2 position, and thus moved away from the oppositely positioned, inner ends of cut-out portions 5A and 6A, nevertheless remain within said cut-out portions 5A and 6A and maintain the effective barrier to the flow of molten aluminum despite the pulling apart of end plate 1 and side plate 3. To achieve the snug fit of refractory sheet member 4 therein, said cut-out portions 5A and 6A are desirably of essentially the same width as said refractory sheet member 4, allowing sufficient clearance for the positioning of said sheet member 4 within said cut-out portions 5A and 6A. The desirably enlarged portions 5B and 6B of cut-out portions 5 and 6, which face and adjoin one another, are of greater width than that of portions 5A and 5B to facilitate placement of refractory sheet member 4 in cut-out portions 5 and 6 and particularly to allow room for said refractory sheet member 4 to assume its angled position upon the pulling apart of plates 1 and 3.

The size of the cut-out portions 5 and 6 and of refractory sheet member 4 will be understood to be variable so long as their relative sizes are such as to assure the desired prevention of the passage of molten aluminum through the opening between the side and end plates in operation. In a typical embodiment, cut-out portions 5 and 6 have an overall width of about ¾", with inner, narrower portions 5A and 6A being about ⅜" and the width of enlarged portions 5B and 6B also being about ⅜" with the diverging sides of Y-shaped enlarged portions 5B and 6B being at an angle of about 45° one to the other. In this embodiment, the inner, narrower portions 5A and 6A have a thickness of about 3/16". For the desired snug fit therein, refractory sheet Y has a thickness of about 3/16" with a slight clearance to allow its insertion in said inner, narrower portions and an overall width of about 1½", i.e. about twice the overall length of each cut-out portion 5 and 6. Such specific dimensions are provided for illustrative purposes only, and should not be construed as defining or limiting the scope of the invention as hereinafter set forth in the appended claims. Those skilled in the art will appreciate that the actual dimensions of the cut-out portions, whether of the preferred Y-shaped configuration, of single slotted configuration or of any other shape or design, and or refractory sheet member 4 will be determined depending upon the size and construction of the particular refining vessel employed and the expected motion of the joint assembly that needs to be accommodated in a particular application.

The cut-out portions of the side and end plates conveniently extend vertically along the entire height of the plates. The refractory sheet member extends vertically from above the intended operating level of molten aluminum in the vessel for holding and/or refining aluminum to below the point at which the plates are pulled apart upon heating. It is generally convenient to have said refractory sheet member extend to the bottom of the plates.

Refractory sheet 4 must, of course, be resistant to attack by aluminum to fulfill the protective lining purposes of the invention. While rigid and brittle materials, such as molded silicon carbide or alumina, could be used in the practice of the invention, it is preferred that the refractory sheet member be of a flexible material so as to facilitate the assuming of an angled, bent position, as in the FIG. 2 embodiment, while maintaining an effective barrier. Such a sheet commercially available is ZIRCAR TM Refractory Sheet Type 100, having useful properties to 2400° F., marketed by Zircar Products, Inc. Such sheets, described as ceramic fiber reinforced structural alumina product and comprising about 75% alumina ($Al_2O_3$), 16% silica and 9% of other metal oxides, have highly desirable flexural and compressive strengths in the range of high temperature reinforced plastics, but retain strength and utility to levels far exceeding the maximum use temperatures of common plastics. A variety of other commercially available materials can also be employed in the practice of the invention, including vacuum formed refractory fiber board made by Rex-Roto Corp. and others, and refractory fiber sleeving made by 3M Corp. and sold under the trademark Nextel.

The invention provides a useful advance in the aluminum refining art. The invention thus enables the graphite side and end plates to be conveniently positioned in a manner accommodating the pulling apart thereof that occurs at the upper end thereof upon heating to operative temperature, while effectively preventing the flow of molten aluminum therethrough. The invention thus enables the tub life of such refining vessels to be extended in a manner highly desirable in the aluminum refining art.

What is claimed is:

1. In a protective lining for a vessel for the holding, with or without refining, of molten aluminum, comprising a graphite side plate and an end plate adapted to be fitted closely together at a side thereof, said plates being secured together at the lower ends thereof, but being attached at the upper ends thereof to the walls of an outer, externally heated, cast iron tub and capable of being pulled apart, one from the other, at said upper ends thereof upon expansion of the tub during heating of the operating temperature of the vessel, thereby opening a channel for the flow of molten aluminum between the refining space within the vessel and the space between the plates and said cast iron tub, the improvement comprising:

(a) graphite side and end plates having cut-out portions at corresponding portions along the height thereof at the joint between said plates as said plates are fitted closely together, said cut-out portions extending vertically from the top of the plates to the point at which said plates are not pulled apart upon heating;

(b) a refractory sheet member not susceptible to attack by molten aluminum, said sheet member being positioned across said corresponding cut-out portions of the side and end plates as fitted closely together, said sheet member extending in length vertically in said cut-out portions from above the intended operating level of molten aluminum to below the point at which said plates are pulled part upon heating, the width and thickness of said sheet member being such, relative to said cut-out portions, that, as the plates are pulled apart at the upper ends thereof upon heating of the vessel to operating temperature, the refractory sheet member serves as an effective barrier to the flow of molten aluminum through the channel otherwise created by the pulling apart of said side and end plates, whereby the joint between the side and end plates allows relative motion as required upon heating the vessel to operating temperature, while maintaining an effective barrier to the flow of aluminum between the plates in their pulled-apart position.

2. The apparatus of claim 1 in which said side and end plates are held in contact at the bottom ends thereof by tongue and groove joints.

3. The apparatus of claim 1 in which said cut-out portions are generally Y-shaped with enlarged portions faced each other as the plates are closely fit together, said enlarged portions serving to facilitate the angled positioning of said refractory sheet member in response to the off-set of said plates at operating temperature.

4. The apparatus of claim 3 in which the width and thickness of said refractory sheet member is such, relative to the inner, narrower portions of said cut-out portions, that said refractory sheet member remains in said inner, narrower portions upon heating to operating temperature.

5. The apparatus of claim 1 in which said refractory sheet member is composed of a flexible material, enabling said sheet member to bend in accommodating an off-set of said plates upon the pulling apart thereof.

6. The apparatus of claim 5 in which said sheet number comprises a ceramic fiber reinforced structural alumina material.

* * * * *